United States Patent [19]

Farley

[11] Patent Number: 4,651,541

[45] Date of Patent: Mar. 24, 1987

[54] JEWELRY CHAIN SEPARATOR

[75] Inventor: Chrys M. Farley, Douglasville, Ga.

[73] Assignee: Nancy C. McDowell, a part interest

[21] Appl. No.: 741,621

[22] Filed: Jun. 5, 1985

[51] Int. Cl.[4] ..... A44C 25/00

[52] U.S. Cl. ..... 63/2; D11/87

[58] Field of Search ..... 63/2, 20, 1 R, 1 A, 63/21; D11/86, 87

[56] References Cited

U.S. PATENT DOCUMENTS

D. 265,804 8/1982 Barr ..... D11/8

2,521,589 9/1985 Livingston ..... 63/20

4,549,411 10/1985 Ivey ..... 63/2

*Primary Examiner*—Richard J. Johnson

*Attorney, Agent, or Firm*—Harvey B. Jacobson

[57] ABSTRACT

A jewelry chain separator comprising an elongated rod-like body having opposite end enlargements thereon. At least one additional enlargement is carried by the body spaced equally between the opposite end enlargements and the rod-like body is substantially cylindrical in shape while the enlargements are spherical in shape.

8 Claims, 5 Drawing Figures

JEWELRY CHAIN SEPARATOR

BACKGROUND OF THE INVENTION

1. Field of the Invention

This invention relates to a separator for maintaining individual necklace or bracelet chains of different lengths against tangling and peripheral slippage relative to each other.

DESCRIPTION OF RELATED ART

Various different forms of jewelry chain or necklace connectors heretofore have been provided such as those disclosed in U.S. Pat. Nos. 3,208,238, 3,135,031, 2,586,758, 1,746,054 and 1,515,499. However, these previously known forms of separators have not been specifically designed for use in conjunction with individual jewelry chains or necklaces including first and second ends provided with closed and openable loops, respectively. Accordingly, a need exists for a jewelry chain or necklace separator which may be used in conjunction with different length chains or necklaces and wherein each chain or necklace is provided with a closed loop on one end and an openable loop on the other end, as is conventional with individual jewelry chains.

SUMMARY OF THE INVENTION

The jewelry chain separator of the instant invention comprises an elongated rod-like body including opposite end spherical enlargements thereon and one or more additional spherical enlargements thereon equally spaced along the body intermediate the end enlargements. Each area of the rod-like body between adjacent enlargements may have the openable loop on one end of a given necklace or jewelry chain engaged thereabout and at the same time engaged through the closed loop on the other end of the necklace or chain. The width of the rod-like body is sufficiently small to enable the openable loop of an associated necklace or chain to be engaged about the rod-like body as well as through the closed loop on the other end of the necklace or chain. However, the size of the enlargements are sufficient, in comparison to the size of the openable loop, to prevent the openable loop from passing over either of the enlargements between which the openable loop is engaged about the rod-like body.

The main object of this invention is to provide a separator which will maintain the openable loops of individual jewelry chains or necklaces in substantially the same location and prevent the necklaces or chains from peripherally shifting relative to each other.

Another object of this invention is to provide a jewelry chain or necklace separator constructed in a manner whereby, when the separator is utilized in conjunction with a plurality of chains or necklaces of different lengths, the necklaces or chains will be prevented from peripheral displacement relative to each other and the openable loops of a plurality of necklaces may be maintained at the back of the neck of the wearer.

Yet another object of this invention is to provide a chain separator in accordance with the preceding objects and which may be used in conjunction with various different size openable necklace or chain loops.

A final object of this invention to be specifically enumerated herein is to provide a chain or necklace separator in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
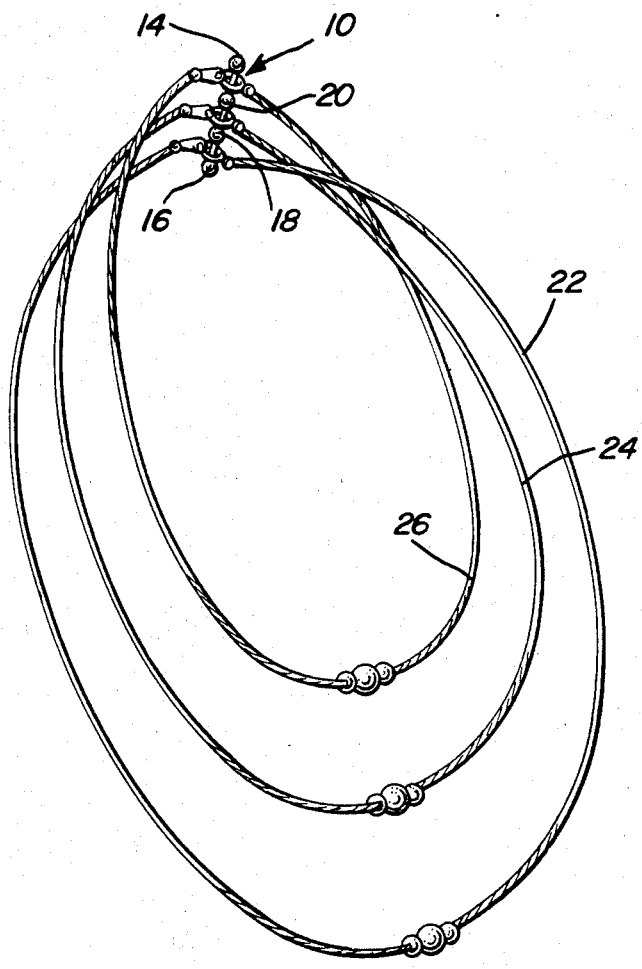
FIG. 1 is a perspective view of the chain separator in operative association with three necklace chains of different lengths.

Referring now more specifically to the drawings the numeral 10 generally designates the jewelry chain separator of the instant invention. The separator 10 includes an elongated solid cylindrical rod 12 including opposite end spherical enlargements 14 and 16 thereon. In addition, the separator 10 includes a second pair of spherical enlargements 18 and 20 spaced apart equally along the rod 12 intermediate the enlargements 14 and 16.

The separator 10, with its four enlargements 14, 16, 18 and 20 is specifically designed to be used in conjunction with three necklaces 22, 24 and 26. The necklaces 22 and 26 are longer and shorter, respectively, than the necklace 24.

Figure 3:
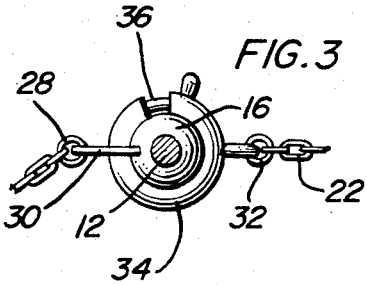
FIG. 3 is an enlarged transverse sectional view of the chain separator and illustrating the manner in which the openable loop at one end of a necklace chain may be engaged about the rod-like body of the separator as well as through the closed loop carried on the other end of the necklace.
Figure 4:
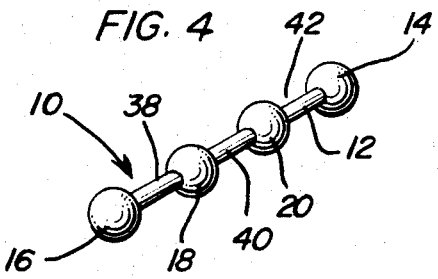
FIG. 4 is a perspective view of the chain separator.

With attention now invited more specifically to FIG. 3 of the drawings it may be seen that the necklace 22 includes a first end 28 upon which a closed anchor loop 30 is secured and a second end 32 upon which an openable anchor loop 34 is secured. The necklace 22 is of conventional design and the loop 34 may be opened at 36 to allow the loop 30 to be disengaged from the loop 30. Then, the necklace 22 may be placed about the neck of the intended wearer and the loop 30 may be engaged with the loop 34 and loop 34 may be engaged about the rod 12 between the corresponding enlargements.

Present day fashion includes the use of multiple necklaces of different lengths, such as the necklaces 22, 24 and 26 illustrated in FIG. 1, but when multiple necklace chains are used one or more of those chains invariably shifts peripherally about the neck of the wearer so that the loops 30 and 34 thereof do not remain at the back of the neck of the wearer.

Figure 2:
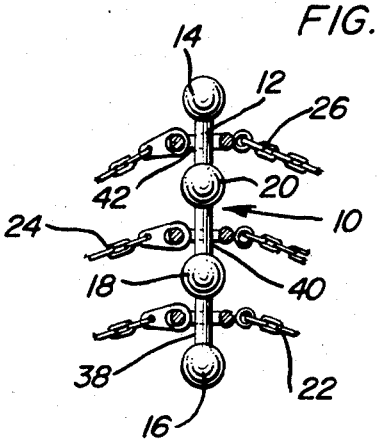
FIG. 2 is an enlarged elevational view of the chain separator with the adjacent ends of the associated necklace chains fragmentarily illustrated.

The separator of the instant invention provides three areas 38, 40 and 42 thereon with which the necklaces 22, 24 and 26 may be engaged, see FIG. 2. In this manner, the necklaces 22, 24 and 26 are prevented from relative peripheral displacement and the separator 10 and corresponding ends of the chains 22, 24 and 26 are retained at the back of the neck of the user.

In usage, the separator 10 is positioned back of the neck of the user with the lengthwise direction of the separator 10 extending upwardly along the back of the user's neck. The shorter necklace 22 is anchored to the area 42, the intermediate length necklace 24 is anchored to the area 40 and the longer necklace 22 is anchored to the area 38. By this arrangement the separator 10, and thus the corresponding ends of the necklaces 22, 24 and 26, tend to remain at the back of the neck of the wearer.

It is pointed out that the loops 34 are of sufficient size to receive the loops 30 therein and to also receive the rod 12 therethrough. However, the enlargements 14, 16, 18 and 20 are of a diameter greater than the inside diameter of the loops 34. Accordingly, once the necklaces 22, 24 and 26 have been anchored to the areas 38, 40 and 42, the corresponding ends of the necklaces may not shift past the adjacent enlargements on the separator 10.

The separator 10 may be constructed of precious metals, or it may be constructed of other metals and plated or otherwise coated with a precious metal. Further, the enlargements 18 and 20 initially may have diametric bores formed therethrough and may be silver soldered or otherwise secured on the rod 12 and the enlargements 14 and 16 may have radial bores formed thereon and may be similarly secured to the opposite ends of the rod 12. Of course, the separator 10 also may be constructed by other methods such as casting.

Figure 5:
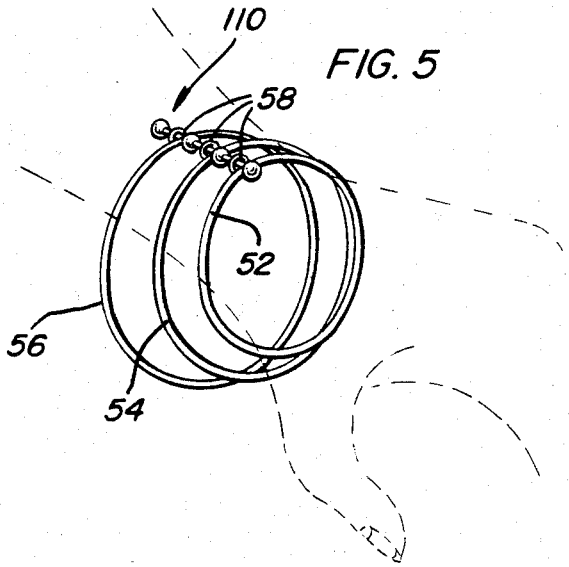
FIG. 5 is a perspective view illustrating the manner in which the chain separator may be used in conjunction with three wrist chains.

With attention now invited more specifically to FIG. 5, there may be seen a separator 110 in use maintaining different length bracelets 52, 54 and 56 in spaced apart relation at those peripheral portions of the bracelets 52, 54 and 56 which open. Of course, the openable bracelets also include loops 58 corresponding to the loops 34 by which the bracelets 52, 54 and 56 may be anchored to and in position on the separator 10.

All of the enlargements 14, 16, 18 and 20 are spherical. Therefore, when an opened loop 34 is being advanced for engagement about a given rod portion, the spherical enlargements at the opposite ends of that rod portion coact with the ends of the open loop 34 as guides therefor to automatically deflect or cam the opened loop 34 into proper alignment with the rod portion extending between and connecting the pair of adjacent enlargements for ease of engagement of the opened loop about the rod portion when a user of the separator is attempting to connect one of the chains to the separator.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A jewelry chain separator including an elongated rod-like body having opposite end enlargements thereof and at least one additional enlargement thereon spaced between said opposite end enlargements, a pair of jewelry chains each including a pair of free ends with a closed anchor loop on one end and an openable anchor loop on the other end releasably removably anchored with said closed loop, said openable loop of each chain being of sufficient internal size to also pass about said body intermediate a corresponding pair of adjacent enlargements and being of sufficiently small internal size to prevent said openable loop from passing over either of said corresponding pair of adjacent enlargements, said enlargements and openable loops being constructed and arranged so that said enlargements form guides to automatically cam a said opened loop into engagement with said rod portion when the user is attempting to connect one of said chains to said separator.

2. The chain separator of claim 1 wherein said enlargements are generally spherical in shape and the longitudinal center axis of said body lies substantially upon diameters of said enlargements.

3. The chain separator of claim 1 wherein said rod-like body includes a pair of additional enlargements thereon equally spaced between said opposite end enlargements, and a third jewelry chain having closed and openable loops on its opposite ends, the last mentioned openable loop being removably engaged through the last mentioned closed loop and also about said rod intermediate a third pair of adjacent enlargements thereon.

4. The chain separator of claim 3 wherein said chains are of different lengths and the openable loops of the longest and shortest chains are engaged about said body immediately adjacent said end enlargements.

5. The chain separator of claim 4 wherein said enlargements are generally spherical in shape and the longitudinal axis of said body lies substantially upon diameters of said enlargements.

6. The chain separator of claim 1 wherein said separator is constructed of metal.

7. The chain separator of claim 1 wherein said rod is of solid construction.

8. The chain separator of claim 1 wherein said enlargements each project outwardly in all radial directions from said rod-like body.

* * * * *